US011035638B1

(12) United States Patent
Gangl et al.

(10) Patent No.: US 11,035,638 B1
(45) Date of Patent: Jun. 15, 2021

(54) RIFLE BARREL HAVING MUZZLE DEVICE WITH ACCESS PORTS

(71) Applicant: J & K IP ASSETS, LLC, Cheyenne, WY (US)

(72) Inventors: Matthew Gangl, Falcon Heights, MN (US); David James Cammack, New Brighton, MN (US); Steven Uscensky, St. Louis Park, MN (US)

(73) Assignee: J & K IP Assets, LLC, Cheyenne, WY (US)

( * ) Notice: Subject to any disclaimer, the term of this patent is extended or adjusted under 35 U.S.C. 154(b) by 0 days.

(21) Appl. No.: 16/776,400

(22) Filed: Jan. 29, 2020

Related U.S. Application Data

(60) Provisional application No. 62/798,066, filed on Jan. 29, 2019.

(51) Int. Cl.
*F41A 29/00* (2006.01)
*F41A 21/32* (2006.01)
*F41A 21/34* (2006.01)

(52) U.S. Cl.
CPC ..... *F41A 29/00* (2013.01); *F41A 21/325* (2013.01); *F41A 21/34* (2013.01)

(58) Field of Classification Search
CPC ..... F41A 29/00; F41A 21/00; F41A 21/08; F41A 21/38; F41A 21/325; F41A 21/34
USPC ..... 89/14.2
See application file for complete search history.

(56) References Cited

U.S. PATENT DOCUMENTS 3,380,344 A * 4/1968 Bucklisch ..... F41A 1/06 89/14.3
3,491,650 A * 1/1970 Rohr ..... F41C 23/06 89/194
5,097,614 A * 3/1992 Strong ..... F41A 21/28 42/76.01
5,136,923 A * 8/1992 Walsh, Jr. ..... F41A 21/30 89/14.2

(Continued)

OTHER PUBLICATIONS https://www.tacticalsol.com/x-ring-series/x-ring-sb-x-barrel (printed from the internet on Nov. 13, 2019).

(Continued)

*Primary Examiner* — Joshua E Freeman
(74) *Attorney, Agent, or Firm* — Haynes and Boone, LLP; William B. Nash; Jason W. Whitney

(57) ABSTRACT

A barrel assembly for a rifle comprising an elongated barrel having an exterior surface, an interior cylindrical bore defining a caliber, a muzzle with a crown, and a rear end with an enlarged cavity capable of receiving a round of ammunition; an elongated muzzle device permanently attached to the exterior surface of the barrel and surrounding and extending past the crown, the muzzle device including a longitudinal opening coaxial to the bore and one or more access ports positioned adjacent to the crown, such that the crown is located radially inward relative to the one or more access ports; a sleeve slidably mounted to an exterior surface of the muzzle device and capable of sliding between an open position and a closed position; wherein, when the sleeve is in the open position, the crown is accessible through the one or more access ports; and wherein, when the sleeve is in the closed position, it seals and completely covers the one or more access ports.

10 Claims, 9 Drawing Sheets

(56) References Cited

U.S. PATENT DOCUMENTS

| | | | | |
|---|---|---|---|---|
| 5,355,765 | A * | 10/1994 | Rogers | F41A 13/12 89/14.4 |
| 6,079,311 | A * | 6/2000 | O'Quinn | F41A 21/30 42/79 |
| 7,587,969 | B2 * | 9/2009 | Silvers | F41A 21/30 181/223 |
| 7,789,008 | B2 * | 9/2010 | Petersen | F41A 21/30 89/14.4 |
| 8,087,338 | B1 * | 1/2012 | Hines | F41A 21/36 89/14.4 |
| 8,429,846 | B2 | 4/2013 | Krieger | |
| 8,505,431 | B2 * | 8/2013 | Hines | F41A 21/36 89/14.4 |
| 9,103,618 | B2 * | 8/2015 | Daniel | F41A 21/325 |
| 9,976,830 | B2 * | 5/2018 | Leone | F41A 21/28 |
| 10,234,231 | B2 * | 3/2019 | Gianelloni, III | F41A 21/30 |
| 2011/0265365 | A1 * | 11/2011 | Alonso Tricio | F41A 21/18 42/78 |
| 2015/0377580 | A1 | 12/2015 | Kress | |
| 2017/0299291 | A1 * | 10/2017 | Spector | F41A 13/12 |
| 2017/0299311 | A1 * | 10/2017 | Daniel | F41A 5/26 |
| 2017/0350670 | A1 * | 12/2017 | Grob | F41A 21/18 |
| 2018/0238653 | A1 * | 8/2018 | Kunsky | F41A 21/325 |
| 2018/0245871 | A1 * | 8/2018 | Goggel | F41A 21/30 |
| 2018/0274873 | A1 * | 9/2018 | Thomas | F41A 21/30 |
| 2019/0178598 | A1 * | 6/2019 | McMillan | F41A 21/48 |
| 2019/0360772 | A1 * | 11/2019 | Waits | F41A 5/28 |
| 2020/0309478 | A1 * | 10/2020 | Meaux | F41A 21/30 |

OTHER PUBLICATIONS https://www.tacticalsol.com/tsar (printed from the Internet on Nov. 13, 2019).

https://www.accurateshooter.com/gear-reviews/bloop-tubes-from-norm-houle/ (printed from the Internet on Nov. 13, 2019).

https://taccom3g.com/product/taccom-45acp-ulw-pcc-barrel/ (printed from the internet on Nov. 13, 2019).

https://www.gemtech.com/catalog/product/view/id/375/s/mist-22/category/11/ (printed from the internet on Nov. 13, 2019).

"JP Enterprises Offers Details on Eye-Catching MR-19 Rifle," Guns.com (printed from the Internet on Nov. 27, 2019) (5 pages).

"JP Enterprises Supermatch Ultralight 9MM Stainless Steel w/Alum Shroud Barrel," https://www.brownells.co.uk/SUPERMATCH-ULTRALIGHT-9MM-STAINLESS-STEEL-W/ALUM-SHROUD-BARREL-16-9mm-Luger-Supermatch-Ultral . . . (printed from the Internet on Nov. 27, 2019) (1 page).

"Matte Black X-Ring Takedwon VR SBX Rifle—Backpacker Black Stock," https://tacticalsol.com/Detail.aspx?PROD=1398589&CAT=13298 (printed from the Internet on Nov. 27, 2019) (2 pages).

"TK Products Inc. M1 Muzzle Buddy," https://www.brownells.ie/M1-MUZZLE-BUDDY-TK-PRODUCTS-INC-Springfield-100015393 (printed from the Internet on Nov. 27, 2019) (1 page).

"Drilling a 10/22 Cleaning Port," https://www.africahunting.com/threads/drilling-a-10-22-cleaning-port.48920/ (printed from the internet on Nov. 27, 2019) (6 pages).

"Ruger Announces Second Custom Shop 10/22 Competition Rifle," https://www.ammoland.com/2019/03/ruger-second-custom-shop-10-22-competition-rifle/#axzz66UC8uxy6 (printed from the intemet on Nov. 27, 2019) (3 pages).

* cited by examiner

SECTION B-B

SECTION C-C

RIFLE BARREL HAVING MUZZLE DEVICE WITH ACCESS PORTS

CROSS-REFERENCE TO RELATED APPLICATIONS

This application claims the benefit of U.S. Provisional Application No. 62/798,066, filed Jan. 29, 2019.

BACKGROUND OF THE DISCLOSURE

The present specification relates to the field of firearms, and more particularly to improvements for a rifle having a muzzle device permanently attached to the barrel.

The basic purpose of a rifle is to fire a high-speed projectile, the bullet, towards a target. In a simple form, a rifle's components may comprise a stock (which may include a buttstock and forestock), a trigger mechanism, a mechanism to load or chamber rounds (for example, a receiver with a bolt action), and a barrel. The rifle fires the bullet from a round or cartridge, which generally includes the bullet (that is, the projectile), a propellant (including for example gun powder) that ignites to produce gases that propel the bullet, a primer to ignite the propellant, and a case that contains the propellant and keeps the other components together.

Although the basic purpose is the same, rifles come in a wide variety of designs, including break action rifles, bolt action rifles, lever action rifles, semiautomatic rifles, and fully automatic rifles. Depending on the specific rifle design, the various components may have different characteristics and operation. The barrel is one component that performs a similar function for all conventional rifle designs: it holds and direct the bullet as it is pushed by the expanding gases produced by the propellants.

To increase accuracy and performance of the barrel, a variety of devices may be attached to or extend from the front end of the barrel, called the muzzle. These muzzle devices alter the rifle characteristics in some manner, including for example muzzle devices that may diminish the amount of flash, reduce the muzzle rise, lessen the felt recoil, dampen noise levels, or affect a combination of these properties. Typical muzzle devices include shrouds, flash hiders, suppressors, muzzle brakes, and compensators. Muzzle devices maybe removably attached, such as by threading, or permanently attached.

Over time and with repeated use, carbon and other deposits can build up on the rifle, including at the tip of the barrel's muzzle, the crown. These deposits form as a result of propellant burning as well as unburned residue, graphite, and other sources. The deposits can significantly and detrimentally alter barrel accuracy and performance, particularly when the deposits break or become uneven. Rifles with a muzzle device attached to the barrel tend to have a higher rate of carbon deposit buildup at the crown because the muzzle device acts to slow, redirect, or otherwise change the discharge of propellant gases and exhaust from the barrel.

These deposits can be removed with commercial solvents or carbon cleaners together with careful, gentle brushing. However, the presence of muzzle devices complicates the cleaning process. If a muzzle device is removably attached, then cleaning may be accomplished by removing the muzzle device first followed by cleaning. For permanently attached muzzle devices, effectively cleaning the crown can be difficult or even impossible, as the barrel crown is deep inside the muzzle device and inaccessible. While a long rod with a brush may be used to reach the crown area, the crown shape and geometry of the barrel and muzzle device often leave areas resistant or insusceptible to cleaning. Moreover, using a brush on a long rod poses an increased risk of damage to the crown, which could ruin the accuracy of the barrel, and crown damage cannot be fixed when the muzzle device is permanently attached. No solution for this problem has been previously identified.

The present disclosure describes a novel and effective design that solves the problem of cleaning deposits around the crown of a barrel with a permanently-attached muzzle device, a solution that provides access to the crown when cleaning is required while maintaining normal operation and performance otherwise.

SUMMARY

Various embodiments of improvements to a rifle barrel with a muzzle device permanently affixed thereto are described herein. In some embodiments, the muzzle device includes one or more lateral ports that allow access to the barrel crown to facilitate cleaning and maintenance of the crown. In some embodiments, the muzzle device includes a sleeve or one or more covers for the ports, which may seal off propellant gases and provide normal functioning of the muzzle device. In some embodiments, the muzzle device includes a detent clip or other means of restraining the sleeve or one or more covers.

DETAILED DESCRIPTION OF ILLUSTRATIVE EMBODIMENTS

Figure 1:
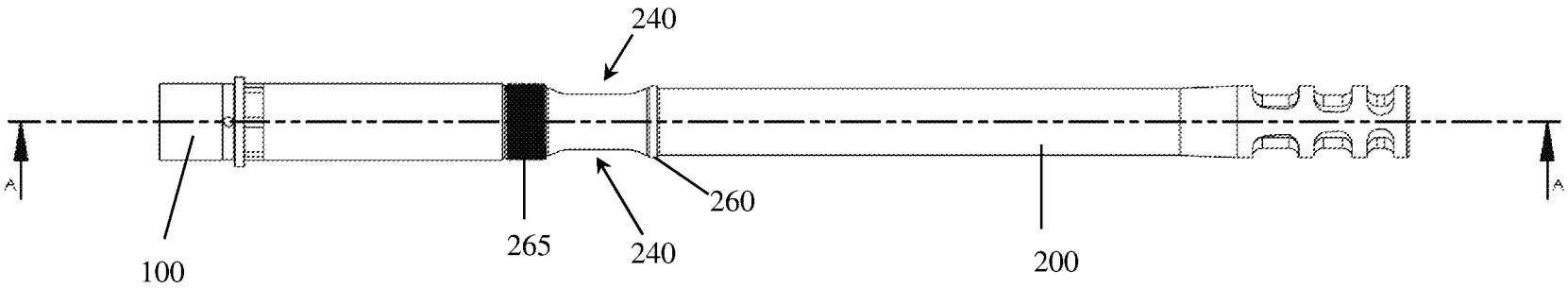
FIG. 1 is a side view of a barrel with a permanently attached shroud in accordance with one or more embodiments of the present disclosure.
Figure 2:
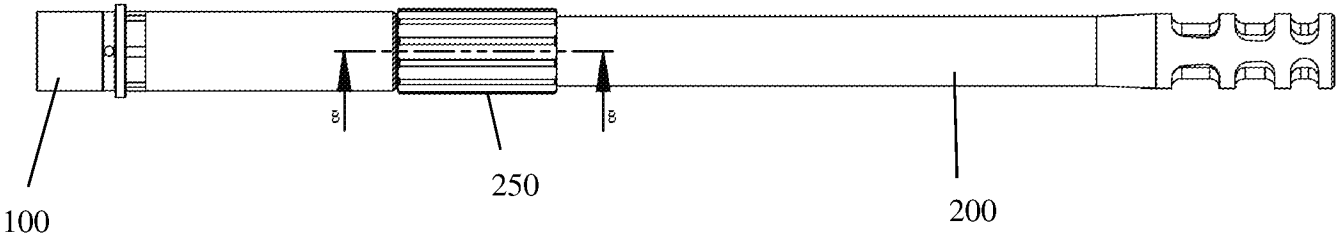
FIG. 2 is a side view of a barrel with a permanently attached shroud and sleeve in a closed position in accordance with one or more embodiments of the present disclosure.
Figure 3:
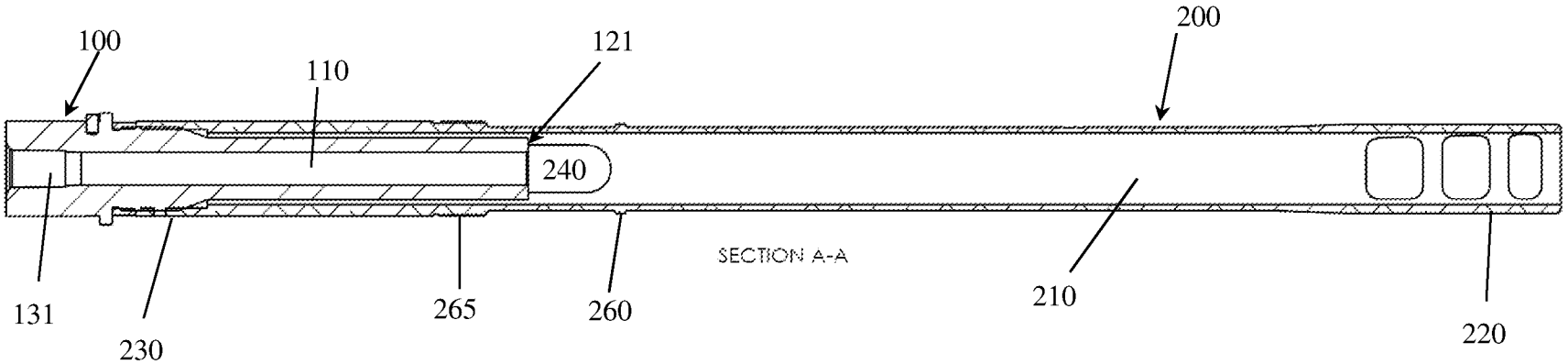
FIG. 3 is a cross-sectional view of the barrel with a permanently attached shroud of FIG. 1.
Figure 4:
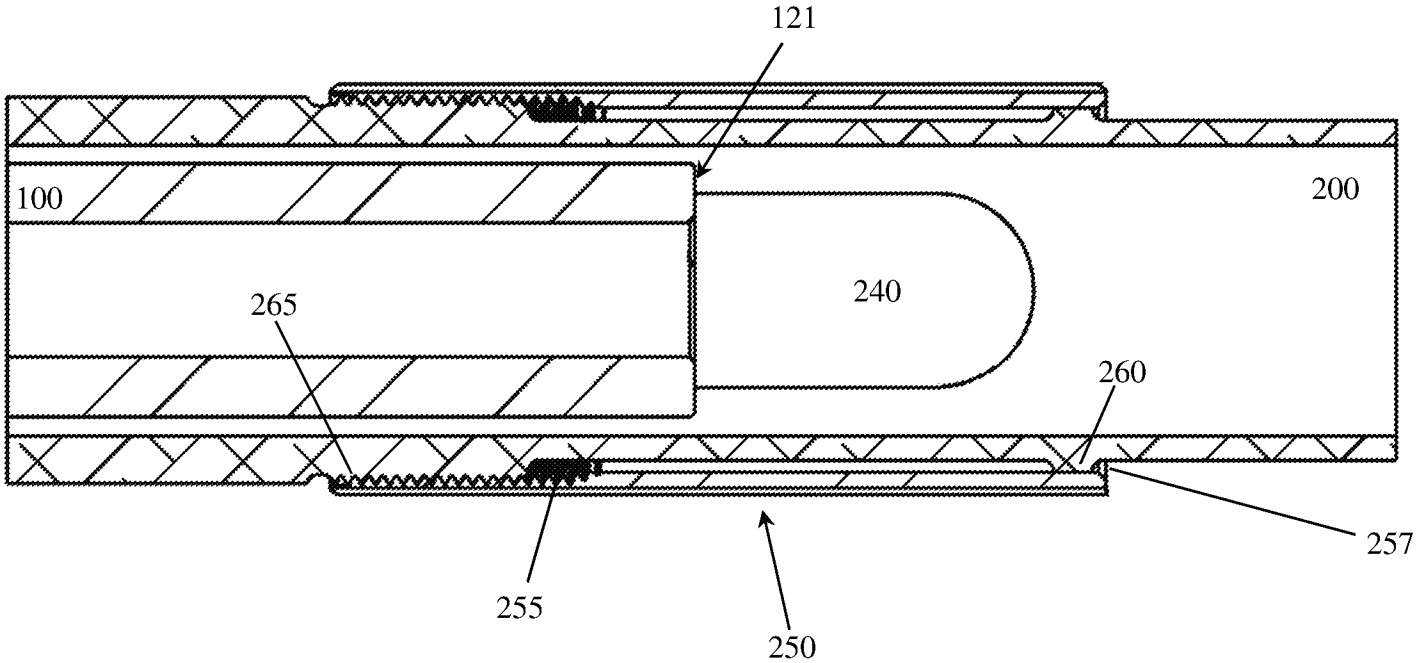
FIG. 4 is an expanded cross-sectional view of the barrel with a permanently attached shroud and sleeve in a closed position of FIG. 2.
Figure 5:
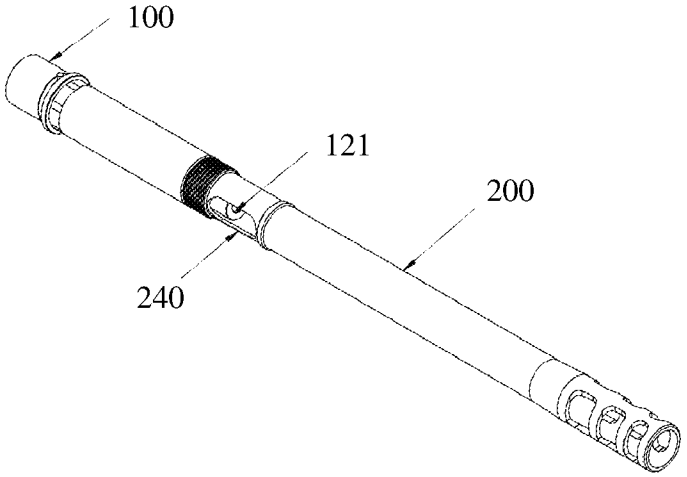
FIG. 5 is a perspective view of a barrel with a permanently attached shroud in accordance with one or more embodiments of the present disclosure.
Figure 6:
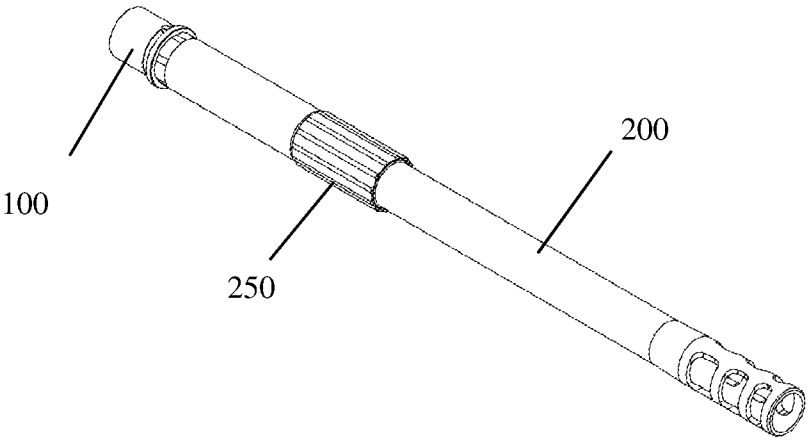
FIG. 6 is a perspective view of a barrel with a permanently attached shroud and sleeve in a closed position in accordance with one or more embodiments of the present disclosure.

The following paragraphs and the attached figures describe in further detail various aspects and embodiments illustrating an improved design for a rifle barrel with a permanently-attached muzzle device, which affords access for cleaning the barrel crown while maintaining normal operation at other times.

Rifle barrel 100 comprises an elongated hollow tube used to fire a bullet from a rifle. The hollow interior of the barrel 100 includes a cylindrical-shaped bore 110 defining an axis and having a diameter, caliber 113, to accommodate bullets of a corresponding size. Common calibers 113 for rifles include 9 mm, .22 Long Rifle (LR), .223 Remington, 5.56× 45 mm NATO, .308 Winchester, .40 S&W, and .45 ACP. The barrel 100 has two ends: a muzzle 120, which is the end of the barrel 100 from which a fired bullet exits, and a rear end 130 that is opposite of muzzle 120 and, in modern rifles, is typically where a round is loaded. Barrel 100 may be formed of various materials capable of withstanding the pressures in firing bullet, including steel, stainless steel, and carbon steel, which are known in the art.

The bore 110 of barrel 100 may include rifling, which refers to a pattern of spiral or helical grooves inside bore 110. The rifling exerts torque on a bullet as it travels the length of bore 110, thus imparting a spin to the bullet around its longitudinal axis during shooting. This spin serves to stabilize the bullet, improving its aerodynamic characteristics and consequently the firearm's accuracy over smooth-bore designs (i.e., bore designs lacking rifling).

The rear end 130 of barrel 100 also typically include a chamber 131. The chamber 131 is a cavity with larger diameter then caliber 113 so as to accommodate the round's casing.

The muzzle 120 includes a crown 121, which is located at the tip of muzzle 120. The crown 121 typically has a concentric, symmetric geometry about the axis of bore 110. The crown 121 will possess a cross-sectional shape or profile. Common profiles of crown 121 include a perpendicular flat surface, a conical depression (for example, an 11-degree target crown), a recessed or stepped profile (for example, a counterbore), and a smooth, rounded profile. Other geometries may be used for crown 121, including asymmetric shapes.

One purpose of crown 121 is to allow propellant gases to exit the bore 110 of barrel 100 uniformly and with low or minimal resistance. Another purpose of crown 121 may be protecting and shielding the rifling from damage by foreign objects or debris. Depending on the profile, the crown 121 may serve one or both of these purposes, as well as others.

Barrel 100 may include a muzzle device to enhance the rifle's accuracy and performance. A muzzle device is attached to the barrel 100, including without limitation at the muzzle 120, and may extend past crown the crown 121. Although not required, the muzzle device may fully enclose a portion of barrel 100. To allow the bullet to be fired properly, a muzzle device will include an opening or channel along the same axis defined by bore 110. The muzzle device's opening or channel through which the bullet passes is larger in diameter than caliber 113 of bore 110. Muzzle devices may be formed of steel or lighter metals such as aluminum or carbon fiber.

Various muzzle devices known are known in the art, including a shroud, flash hider, suppressor, muzzle brake, or compensator, and these may affect various rifle characteristics, including the amount of flash, reduce the muzzle rise, lessen the felt recoil, dampen noise levels, or a combination of properties. Muzzle devices may be removably mounted to the barrel 100, including for example by threading on an exterior surface of barrel 100 and corresponding threading on an interior surface of muzzle device. Alternatively, a muzzle device may be permanently mounted to the exterior of barrel 100. Permanent methods of mounting muzzle device known in the art include full-fusion gas or electric steel-seam welding, high-temperature (1100° F.) silver soldering, and blind pinning with the pin head welded over.

FIGS. 1 through 6 illustrate a first embodiment of an improved rifle barrel 100 having a muzzle device, barrel shroud 200, permanently affixed thereto.

As illustrated in FIGS. 1 through 6, barrel shroud 200 may comprise an elongated hollow tube attached to the barrel 100 of a firearm or rifle. The interior of shroud 200 includes a bore 210 through which the bullet passes, which is larger in diameter than caliber 113 of bore 110. The diameter of bore 210 may be larger than a portion of the outer diameter of barrel 100 as well, so as to enclose the barrel 100. The bore 210 of shroud 200 may have different diameters at different positions along its axis, but in no event less than caliber 113 of bore 110.

Shroud 200 has a rear end 230 that is permanently attached to the barrel 100, such as by welding or pinning (i.e. pin and weld), and an opposing front end 220 from which the bullet exits.

Located between the front end 220 and rear end 230 are one or more lateral openings or ports 240. The ports 240 may be positioned adjacent to the crown 121 of barrel 100 such that crown 121 is accessible through the ports 240. As shown in FIGS. 1 through 6, the shroud 200 may include two elliptical-shaped ports 240 located on opposite sides of the shroud 200. However, a different number, shape, and arrangement of ports 240 may be used, including for example a single elliptical-shaped port located above or below crown 121, multiple narrow ports spaced around shroud 200, or one or more rectangular ports. The ports 240 may extend equally to the front and rear of crown 121 or, as illustrated in FIGS. 1 through 6, they may be positioned closer towards the front end 220 to increase accessibility of the bore 210 immediately in front of crown 121.

As positioned adjacent to crown 121, the ports 240 allow ready access by a user to clean carbon or other deposits that may have accumulated on crown 121.

To maintain to normal rifle operation and performance when the ports 240 are not being used for cleaning, shroud 200 may further comprise one or more covers for the ports 240. The first embodiment therefore includes a sleeve 250 adapted to slide along the exterior surface of shroud 200. In a closed position, shown in FIGS. 2, 4, and 6, the sleeve 250 covers the ports 240. Sleeve 250 may be secured or locked in the closed position on shroud 200 via cooperating components on sleeve 250 and shroud 200, including for example cooperating threading, tabs and slots, or lugs and grooves.

Sleeve 250 may also function to seal off hot, dangerous propellant gases from escaping the ports 240. For example, sealing is important when the ports 240 are positioned at or near a handguard or another location where a user may grip the firearm.

To prevent or minimize propellant gases escaping from ports 240, shroud 200 and sleeve 250 may include one or more sealing surfaces. The embodiment shown in FIGS. 1 through 6 includes sealing surfaces to the front and rear of ports 240. To the front of ports 240, shroud 200 includes a circumferential external flange 260 that engages and mates with a corresponding interior flange 257 positioned at the front of sleeve 250. To the rear of ports 240, the exterior surface of shroud 200 includes threading 265 that engages and mates with corresponding threading 255 on the rear interior of sleeve 250. When the interior threading 255 of sleeve 250 is tightened onto threading 265, the respective sealing surfaces mate together and create seals such that propellant gases are substantially trapped inside the shroud 200.

Other sealing means are known in the art and may be applied to seal the ports 240 of shroud 200. The sleeve 250 or shroud 200 may include one or more gas rings, piston rings, o-rings, or gaskets, including as formed of rubber or metal, to provide a seal. For example, the interior of sleeve 250 may include one or more grooves with one or more rubber o-rings embedded therein that engage the exterior surface of shroud 200 to form a seal. As an alternative to sleeve 250, shroud 200 may include one or more hinged cover plates, together with one or more latches, allowing the hinged cover plates to be closed and latched to seal ports 240.

By covering and sealing the ports 240 with sleeve 250 or other sealing means, the barrel 100 may functional normally together with shroud 200. And, when access to the crown 121 is desired for cleaning, the sleeve 250 can be moved from the closed position to an open position to allow a user to clean the crown 121.

FIGS. 7 through 11 illustrate a second embodiment of an improved rifle barrel 100 having a barrel shroud 200 permanently affixed thereto. In the second embodiment, the barrel shroud 200 further comprises a detent clip 280 that engages and applies tension to the sleeve 250 so as to retain it in a closed position on shroud 200.

Figure 7:
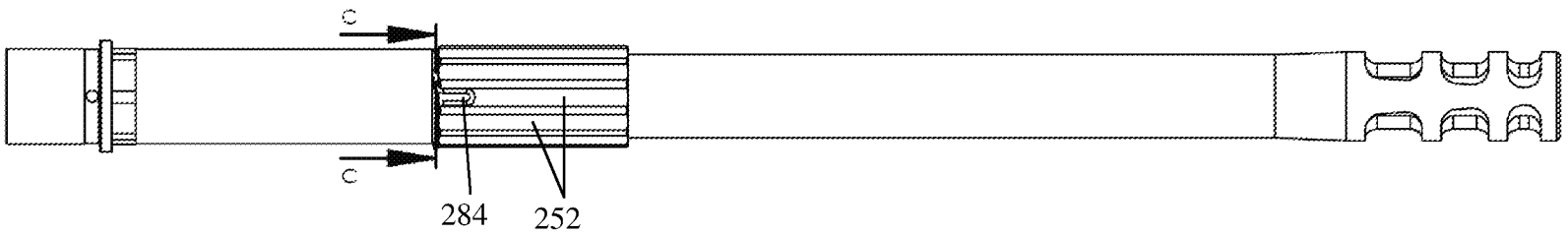
FIG. 7 is a side view of a barrel with a permanently attached shroud, sleeve in a closed position, and detent clip in accordance with one or more embodiments of the present disclosure.
Figure 9:
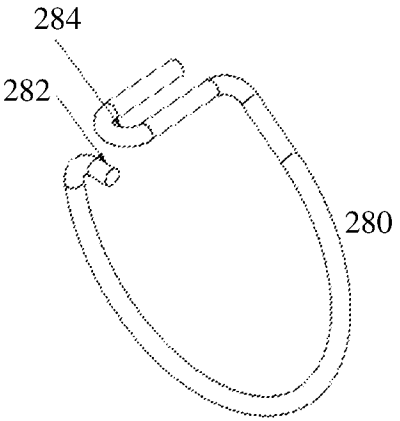
FIG. 9 is a perspective view of a detent clip in accordance with one or more embodiments of the present disclosure.
Figure 8:
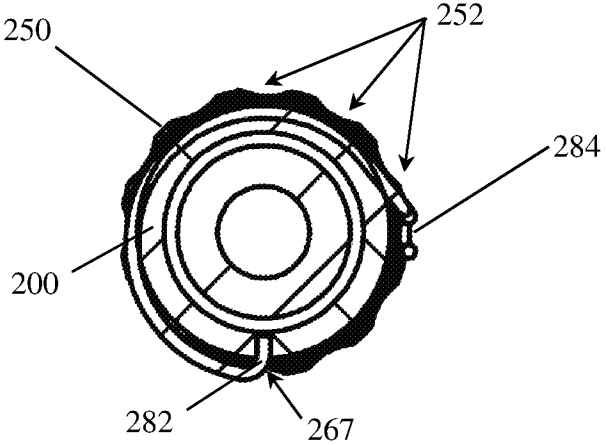
FIG. 8 is a cross-sectional view of the barrel with a permanently attached shroud, sleeve in a closed position, and detent clip of FIG. 7.
Figure 10:
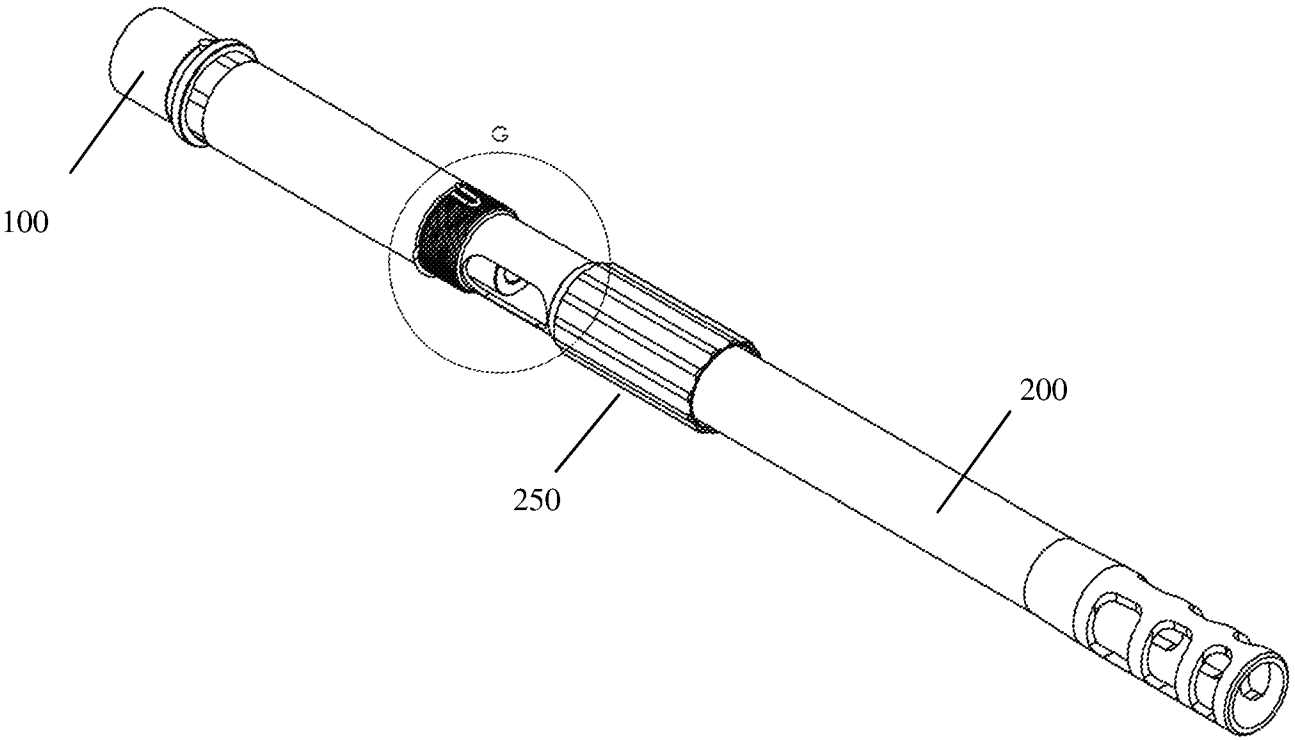
FIG. 10 is a perspective view of a barrel with a permanently attached shroud, sleeve, and detent clip in accordance with one or more embodiments of the present disclosure.
Figure 11:
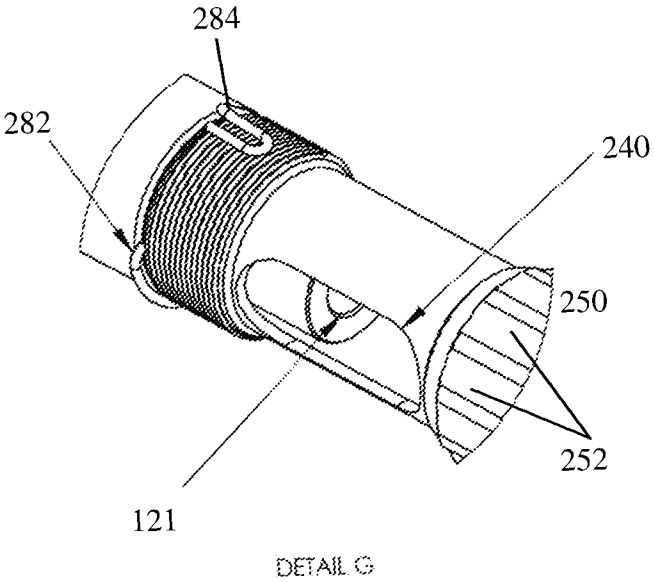
FIG. 11 is an expanded perspective view of the barrel with a permanently attached shroud, sleeve, and detent clip of FIG. 10.

Referring to FIG. 9, the clip 280 may have a semicircular shape, with an elbow 282 at one end and a neck or tab 284 at the other end. FIG. 8 shows clip 280 engaging both shroud 200 and sleeve 250, with the elbow 282 located about two-hundred and seventy degrees from the tab 284. Still referring to FIG. 8, the elbow 282 is configured to engage an opening 267 bored into shroud 200 at or near the rearward portion of threading 265. Referring now to FIGS. 7 and 8, tab 284 is configured to engage one of a plurality of slots 252 on the exterior surface of sleeve 250. The clip 280 may be formed of plastic or steel wire.

Various other means for restraining relative movement and providing tension are known in the art and may be applied with respect to sleeve 250 and shroud 200. For example, springs, including a torsion spring or leaf spring, may be substituted for clip 280. Similarly, a linear spring bar may be used to engage both the sleeve 250 and shroud 200 and apply tension between them. A set screw or tension screw may be threaded into an opening in either the sleeve 250 or shroud 200 and press against the other to apply tension between the components and restrain movement of sleeve 250 relative to shroud 200. A ball detent located in either the sleeve 250 or shroud 200, together with a corresponding indentation in the other to receive the ball, may be used to limit movement of sleeve 250. A jam nut may be threaded onto sleeve 250 or shroud 200 to apply tension and restrict movement. Finally, a spring latch may be used to engage and apply tension between the sleeve 250 or shroud 200. The foregoing mechanisms to provide tension and limit movement are well-known in the art.

Figure 12:
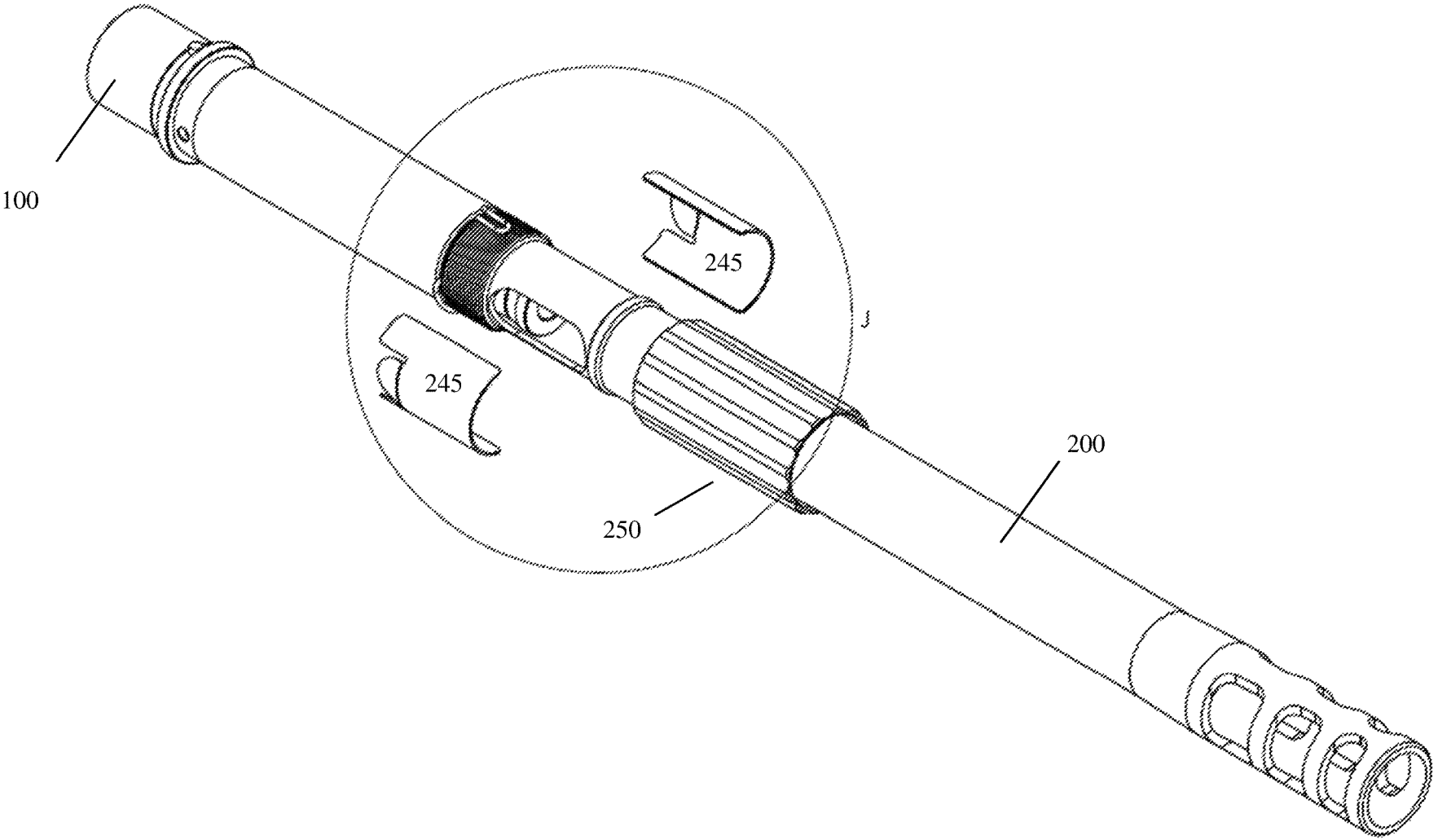
FIG. 12 is a perspective view of a barrel with a permanently attached shroud, sleeve, detent clip, and shims in accordance with one or more embodiments of the present disclosure
Figure 13:
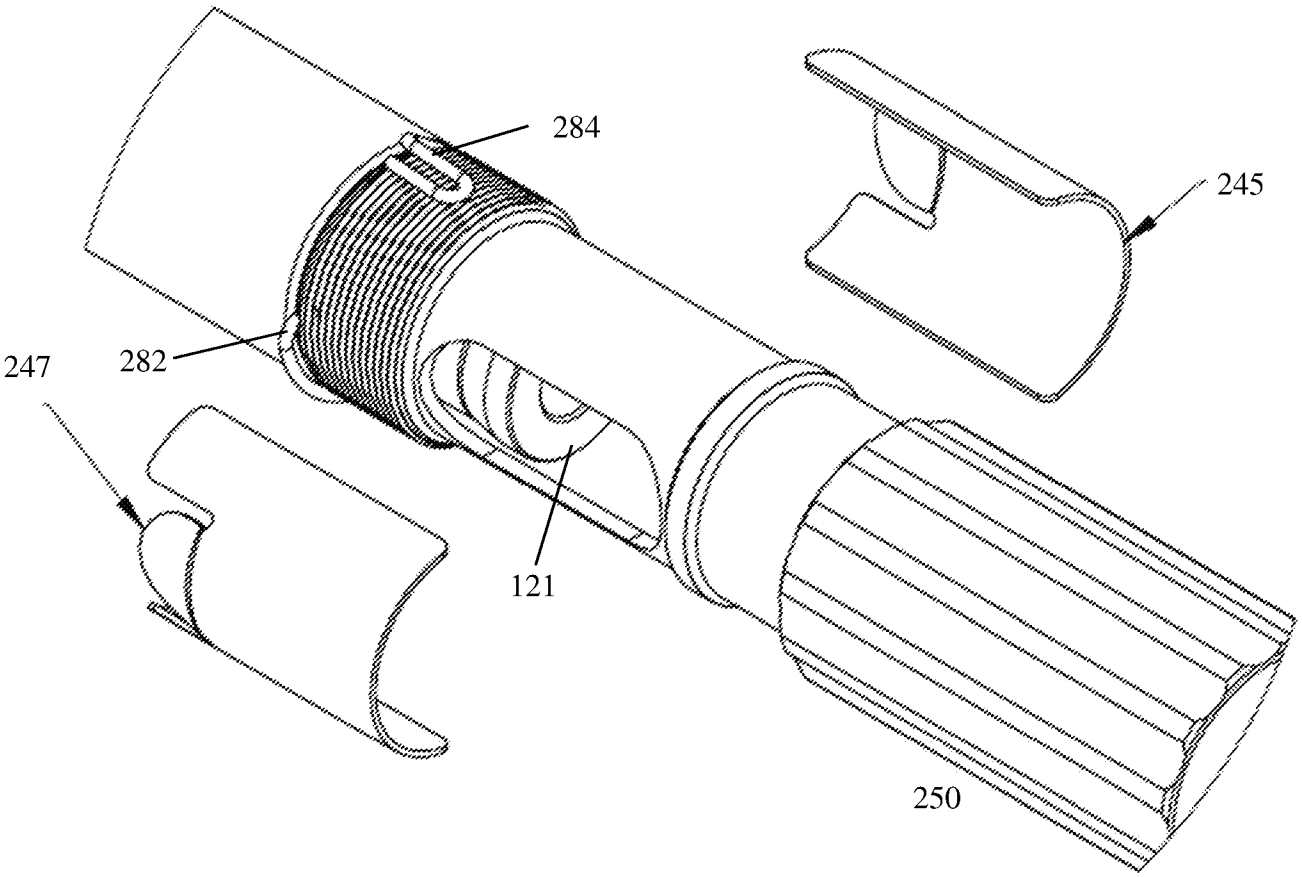
FIG. 13 is an expanded cross-sectional view of the barrel with a permanently attached shroud, sleeve, detent clip, and shims of FIG. 12.

FIGS. 12 through 13 illustrate a third embodiment of an improved rifle barrel 100 with a permanently attached barrel shroud 200.

With heavy use of the rifle, carbon deposits may build up on the interior of sleeve 250 itself, which can make opening the sleeve 250 difficult, particularly when sleeve 250 includes one or more sealing surfaces to limit the escape of propellant gases from ports 240. Indeed, large carbon deposits may even prevent sleeve 250 from any rotation, essentially locking it into place.

As illustrated in FIGS. 12 and 13, in the third embodiment the barrel shroud 200 further comprises one or more shims 245 covering the ports 240 under sleeve 250. The shims 245 may be held in place by the sleeve 250 when in the closed position. Because the one or more shims 245 cover the ports 240 under sleeve 250, they collect most of the carbon buildup from prolonged use. Consequently, although significant carbon deposits may occur on the underlying shims 245, the sleeve 250 may still be rotated and removed easily. Because the dirtied shims 245 are simply held in place by sleeve 250, once the sleeve 250 is removed the shims 245 may be pulled out and cleaned (if reusable) or discarded (if disposable).

Shims 245 may be formed as thin plates or sheets, including steel, stainless steel, aluminum, or other metal, and are relatively inexpensive to manufacture. Each shim 245 may be sized to cover a single port 240. Alternatively, a single shim 245 may substantially wrap around shroud 200 to cover multiple ports 240. The shims 245 may also comprise an indented tab 247, or a pin, screw, or other inwardly protruding feature, for positioning the shims 245 relative to the ports 240.

The improvements described in this specification may be applied in a variety of rifles, including pistol caliber carbines. Although the improvements described in this specification are illustrated using shroud embodiments, the improvements may be applied to a variety of muzzle devices.

In some circumstances, it may be advantageous for the combined length of the improved rifle barrel and permanently attached muzzle device described herein to equal or exceed a minimum length. For example, in the United States, a rifle with a barrel length (including any permanently attached muzzle device) of less than sixteen inches is subject to the additional requirements of the National Firearms Act, including fees and firearm registration requirements. Similarly, in Europe, a rifle with a barrel length of less than 60 cm may be subject to requirements under the European Firearms Directive. Other countries impose additional requirements for barrel lengths of less than 14.5 inches. As such, the combined length of a rifle barrel and permanently attached muzzle device may exceed a minimum threshold to minimize or avoid registration, fees, and other additional firearm-related requirements. For example, in the United States, a rifle barrel of eight inches would require a permanently attached muzzle device of at least eight inches (for a combined total of sixteen inches) to avoid registration under the National Firearms Act. Similarly, a rifle barrel of five inches would require a permanently attached muzzle device of at least eleven inches to avoid registration in the United States.

While the specification describes one or more embodiments, it is not intended to limit the invention or claims to the particular forms set forth. Rather, the specification sets forth the disclosed subject matter by way of example to facilitate discussion. The specification is intended to cover alternatives, modifications, and equivalents as may be included within its spirit and scope. As will be apparent to a person of ordinary skill in the field, the disclosed embodiments are exemplary and not exhaustive of all possible embodiments.

What is claimed is:

1. A barrel assembly for a rifle comprising:

an elongated barrel having an exterior surface, an interior cylindrical bore defining a caliber, a muzzle with a crown, and a rear end with an enlarged cavity capable of receiving a round of ammunition;

an elongated muzzle device permanently attached to the exterior surface of the barrel and surrounding and extending past the crown, the muzzle device including a longitudinal opening coaxial to the bore and one or more access ports positioned adjacent to the crown, such that the crown is located radially inward relative to the one or more access ports;

a sleeve slidably mounted to an exterior surface of the muzzle device and capable of sliding between an open position and a closed position;

wherein, when the sleeve is in the open position, the crown is accessible through the one or more access ports; and wherein, when the sleeve is in the closed position, it seals and completely covers the one or more access ports.

2. The barrel assembly of claim 1, wherein the muzzle device possesses a length that is at least equal to a length of the elongated barrel.

3. The barrel assembly of claim 2, wherein the barrel assembly has a total length at least 16 inches.

4. The barrel assembly of claim 3, wherein the total length of the barrel assembly is between 16 and 18 inches.

5. The barrel assembly of claim 4, wherein the muzzle device is a barrel shroud.

6. The barrel assembly of claim 5, wherein the elongated barrel is formed of stainless steel and the muzzle shroud is formed of aluminum.

7. The barrel assembly of claim 1, wherein the muzzle device further comprises threading on its exterior surface, wherein the sleeve further comprises threading on an interior surface, and wherein when the sleeve is in the closed position, the muzzle device's threading engages the sleeve's threading to form a first seal.

8. The barrel assembly of claim 7, wherein the muzzle device further comprises a flange on its exterior surface, wherein the sleeve further comprises a flange on its interior surface, and wherein when the sleeve is in the closed position, the muzzle device's flange engages the sleeve's flange to form a second seal.

9. The barrel assembly of claim 1, further comprising a detent clip adapted to restrain the sleeve when it is in the closed position.

10. A barrel assembly for a rifle comprising:

an elongated barrel having an exterior surface, an interior cylindrical bore defining a caliber, a muzzle with a crown, and a rear end with an enlarged cavity capable of receiving a round of ammunition;

an elongated muzzle device permanently attached to the exterior surface of the barrel and surrounding and extending past the crown, the muzzle device including a longitudinal opening coaxial to the bore and one or more access ports positioned adjacent to the crown, such that the crown is located radially inward relative to the one or more access ports;

a sleeve slidably mounted to an exterior surface of the muzzle device and capable of sliding between an open position and a closed position;

one or more removable shims configured to fit between the muzzle device and the sleeve and substantially cover the one or more access ports;

wherein, when the sleeve is in the closed position, the removable shims substantially cover the one or more access ports, and the sleeve seals and completely covers the one or more removable shims and the one or more access ports.

* * * * *